US010309233B2

(12) United States Patent
Strock

(10) Patent No.: US 10,309,233 B2
(45) **Date of Patent: *Jun. 4, 2019**

(54) ABRASIVE TIP BLADE MANUFACTURE METHODS

(71) Applicant: United Technologies Corporation, Farmington, CT (US)

(72) Inventor: Christopher W. Strock, Kennebunk, ME (US)

(73) Assignee: United Technologies Corporation, Farmington, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/943,991

(22) Filed: Apr. 3, 2018

(65) Prior Publication Data

US 2018/0223678 A1 Aug. 9, 2018

Related U.S. Application Data

(63) Continuation of application No. 14/636,676, filed on Mar. 3, 2015, now Pat. No. 9,957,819.

(Continued)

(51) Int. Cl.

| | |
|---|---|
| ***F01D 5/28*** | (2006.01) |
| ***B05D 3/00*** | (2006.01) |
| ***B05D 1/02*** | (2006.01) |
| ***F01D 11/12*** | (2006.01) |
| ***C23C 4/06*** | (2016.01) |

(Continued)

(52) U.S. Cl.

CPC ..... *F01D 5/288* (2013.01); *B05D 1/02* (2013.01); *B05D 3/007* (2013.01); *C23C 4/06* (2013.01); *C23C 4/08* (2013.01); *C23C 24/06* (2013.01); *C23C 28/044* (2013.01); *F01D 11/122* (2013.01)

(58) Field of Classification Search

CPC .. B05D 1/02; B05D 3/007; C23C 4/06; C23C 24/06; C23C 28/044

See application file for complete search history.

(56) References Cited

U.S. PATENT DOCUMENTS

| | | |
|---|---|---|
| 3,199,836 A | 8/1965 | Moyer |
| 3,575,427 A | 4/1971 | Lapac et al. |

(Continued)

FOREIGN PATENT DOCUMENTS

| | | |
|---|---|---|
| EP | 1391537 A1 | 2/2004 |
| EP | 2317079 A2 | 5/2011 |
| GB | 2496887 A | 5/2013 |

OTHER PUBLICATIONS

Xiameter PMX-200 Silicone Fluid, 50-1,000 CS, Dow Coming Corporation, Oct. 11, 2012, Midland, Michigan.

(Continued)

*Primary Examiner* — Dah-Wei D. Yuan

*Assistant Examiner* — Kristen A Dagenais-Englehart

(74) *Attorney, Agent, or Firm* — Bachman & LaPointe, P.C.

(57) ABSTRACT

A method is disclosed for manufacturing a blade tip coating. The blade tip coating (152) comprising an abrasive (156) and a matrix (154). The method comprises forming a mixture comprising the abrasive, a precursor of the matrix, and an additional particulate (158). The mixture is pressed, the additional particulate acting as a stop to limit thickness reduction of the mixture.

19 Claims, 6 Drawing Sheets

Related U.S. Application Data

(60) Provisional application No. 61/971,824, filed on Mar. 28, 2014.

(51) Int. Cl.

| | |
|---|---|
| ***C23C 24/06*** | (2006.01) |
| ***C23C 28/04*** | (2006.01) |
| ***C23C 4/08*** | (2016.01) |

(56) References Cited

U.S. PATENT DOCUMENTS

| | | | | |
|---|---|---|---|---|
| 4,610,698 | A * | 9/1986 | Eaton | F01D 11/12 51/293 |
| 4,704,332 | A | 11/1987 | Brennan et al. | |
| 4,735,656 | A * | 4/1988 | Schaefer | B22F 3/1035 75/238 |
| 4,851,188 | A | 7/1989 | Schaefer et al. | |
| 6,232,362 | B1 | 5/2001 | Agars et al. | |
| 6,334,617 | B1 | 1/2002 | Putnam et al. | |
| 6,541,075 | B2 * | 4/2003 | Hasz | C22C 38/005 228/121 |
| 6,641,907 | B1 | 11/2003 | Merrill et al. | |
| 6,780,458 | B2 * | 8/2004 | Seth | C23C 24/04 427/201 |
| 7,901,799 | B2 * | 3/2011 | Feuerstein | C23C 14/0021 416/241 B |
| 8,020,875 | B2 | 9/2011 | Utnam et al. | |
| 2008/0166225 | A1 * | 7/2008 | Strangman | C23C 26/02 415/173.4 |
| 2008/0178536 | A1 | 7/2008 | Johnson | |
| 2011/0002779 | A1 | 1/2011 | Schuster | |
| 2013/0004328 | A1 | 1/2013 | Wrabel et al. | |
| 2013/0071235 | A1 * | 3/2013 | Strock | F01D 11/122 415/174.4 |
| 2013/0105421 | A1 | 5/2013 | Deyhim | |
| 2013/0108421 | A1 | 5/2013 | Sinatra et al. | |
| 2013/0156588 | A1 | 6/2013 | Murdock et al. | |

OTHER PUBLICATIONS

European Search Report, dated Jul. 28, 2015 for European Patent Application No. 15161446.8.

US Office Action, dated Jul. 14, 2016 for U.S. Appl. No. 14/636,676.

US Office Action, dated Feb. 8, 2017 for U.S. Appl. No. 14/636,676.

US Office Action, dated Aug. 17, 2017 for U.S. Appl. No. 14/636,676.

* cited by examiner

ABRASIVE TIP BLADE MANUFACTURE METHODS

CROSS REFERENCE TO RELATED APPLICATION

This is a continuation of U.S. patent application Ser. No. 14/636,676, filed Mar. 3, 2015, and entitled "Abrasive Tip Blade Manufacture Methods" and benefit is claimed of U.S. Patent Application No. 61/971,824, filed Mar. 28, 2014, and entitled "Abrasive Tip Blade Manufacture Methods", the disclosures of which applications are incorporated by reference herein in their entireties as if set forth at length.

BACKGROUND

The disclosure relates to blades and rub coatings. More particularly, the disclosure relates to abrasive blade tips for cooperating with abradable coatings on turbomachines such as gas turbine engines.

Abradable coatings (rub coatings) protect moving parts from damage during rub interaction and wear to establish a mating surface to the moving parts with smallest possible clearance. The coatings are used in turbomachines to interface with the tips of a rotating blade stage, tips of cantilevered vanes and knife edge seals.

In an exemplary turbomachine such as a gas turbine engine, more particularly, a turbofan engine, coatings may be used to interface with the blade tips of fan blade stages, compressor blade stages, and turbine blade stages. Because temperature generally increases through the fan and compressor and is yet much higher in the turbine, different blade materials, surrounding case materials, and coating materials may be desired at different locations along the engine.

With relatively low temperatures in the fan and compressor sections, relatively low temperature materials may be used for their blades and the surrounding cases (at least through upstream (lower pressure) portions of the compressor). The exemplary blade materials in such lower temperature stages may be aluminum alloy, titanium alloy, carbon fiber or other composite, combinations thereof, and the like. Similarly, relatively lower temperature case materials may be provided. Particularly because the case material is not subject to the centrifugal loading that blades are, even lower temperature capability materials may be used (e.g., aramid or other fiber composites) in the case than in the blades.

US Patent Application Publication 20130156588 A1, published Jun. 20, 2013, and entitled "Electrical grounding for fan blades", discloses blades having polyurethane-coated aluminum substrates.

It is known to use a coating along the inboard or inner diameter (ID) surface of the case component to interface with the blade tips. Such coatings serve to protect blade tips from damage during rub contact between the blades and case. When the blade tips are protected from damage during rub, clearance between the blades and case ID can be set closer and tighter operating clearance can be achieved.

To limit blade damage, the adjacent surfaces of the surrounding shroud may be formed by an abradable rub coating. Examples of abradable rub coatings are found in U.S. Pat. Nos. 3,575,427, 6,334,617, and 8,020,875. One exemplary baseline coating comprises a silicone matrix with glass micro-balloon filler. Without the glass filler, the elastic properties of the abradable coating result in vibrational resonances and non-uniform rub response. The glass increases the effective modulus of the coating so as to reduce deformation associated with aerodynamic forces and resonances. More recent proposals include filler such as polymer micro-balloons (PCT/US2013/023570) and carbon nanotubes (PCT/US2013/023566).

For interfacing with the abradable rub coating, the blade tips may bear an abrasive coating. US Patent Application Publication 2013/0004328 A1, published Jan. 3, 2013, and entitled "ABRASIVE AIRFOIL TIP" discloses a number of such coatings.

SUMMARY

One aspect of the disclosure involves a method for manufacturing a blade tip coating. The blade tip coating comprises an abrasive and a matrix. The method comprises forming a mixture comprising the abrasive, a precursor of the matrix, and an additional particulate. The mixture is pressed, the additional particulate acting as a stop to limit thickness reduction of the mixture.

A further embodiment may additionally and/or alternatively include curing the precursor of the matrix.

A further embodiment may additionally and/or alternatively include releasing a release member from the mixture.

Another aspect of the disclosure involves the blade comprising an airfoil having: a root end and a tip; and a substrate along at least a portion of the airfoil. The method comprises applying the mixture to the tip.

A further embodiment may additionally and/or alternatively include the pressing comprising pressing a member against the applied mixture, the additional particulate acting as a stop to limit proximity of the member to the substrate.

A further embodiment may additionally and/or alternatively include curing the precursor of the matrix and releasing the tip coating from the member.

A further embodiment may additionally and/or alternatively include removing a first release member from the pressed mixture prior to the applying and removing a second release member from the pressed mixture after the applying.

A further embodiment may additionally and/or alternatively include the tip coating being a first layer and the method further comprising forming a second layer having a lower abrasive content than the first layer.

A further embodiment may additionally and/or alternatively include the second layer being formed atop the first layer by: forming a second mixture comprising a second abrasive, a second matrix precursor, and a second additional particulate; and pressing the second mixture, the second additional particulate acting as a stop to limit thickness reduction of the second mixture.

A further embodiment may additionally and/or alternatively include the tip coating having a content of the abrasive of at least twenty volume percent.

A further embodiment may additionally and/or alternatively include the tip coating having a content of the additional particulate of three volume percent to ten volume percent.

A further embodiment may additionally and/or alternatively include the additional particulate having characteristic diameter of 0.20 mm to 0.80 mm.

A further embodiment may additionally and/or alternatively include the abrasive having a characteristic size of ten micrometers to 150 micrometers.

A further embodiment may additionally and/or alternatively include the additional particulate being glass bead.

A further embodiment may additionally and/or alternatively include the abrasive being at least 50 percent by weight oxide of one or more of aluminum, titanium, and zirconium.

A further embodiment may additionally and/or alternatively include the abrasive containing alumina as a largest by-weight constituent.

A further embodiment may additionally and/or alternatively include the matrix being an epoxy.

A further embodiment may additionally and/or alternatively include the tip coating having a characteristic thickness of 0.1 mm to 0.3 mm.

A further embodiment may additionally and/or alternatively include the release agent comprising polydimethylsiloxane polymer.

A further embodiment may additionally and/or alternatively include, after applying the tip coating, applying a polymeric coating to a pressure side and a suction side of the airfoil.

A further embodiment may additionally and/or alternatively include the polymeric coating being also applied atop the tip coating.

A further embodiment may additionally and/or alternatively include a blade manufactured according to the method.

A further embodiment may additionally and/or alternatively include a rotor comprising a circumferential array of the blades.

A further embodiment may additionally and/or alternatively include a gas turbine engine comprising: the rotor; and a case encircling the rotor. The case has a substrate and a coating on an inner surface of the substrate facing the rotor.

A further embodiment may additionally and/or alternatively include a method for using the blade, the method comprising causing the tip coating to abrade an adjacent coating.

The details of one or more embodiments are set forth in the accompanying drawings and the description below. Other features, objects, and advantages will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
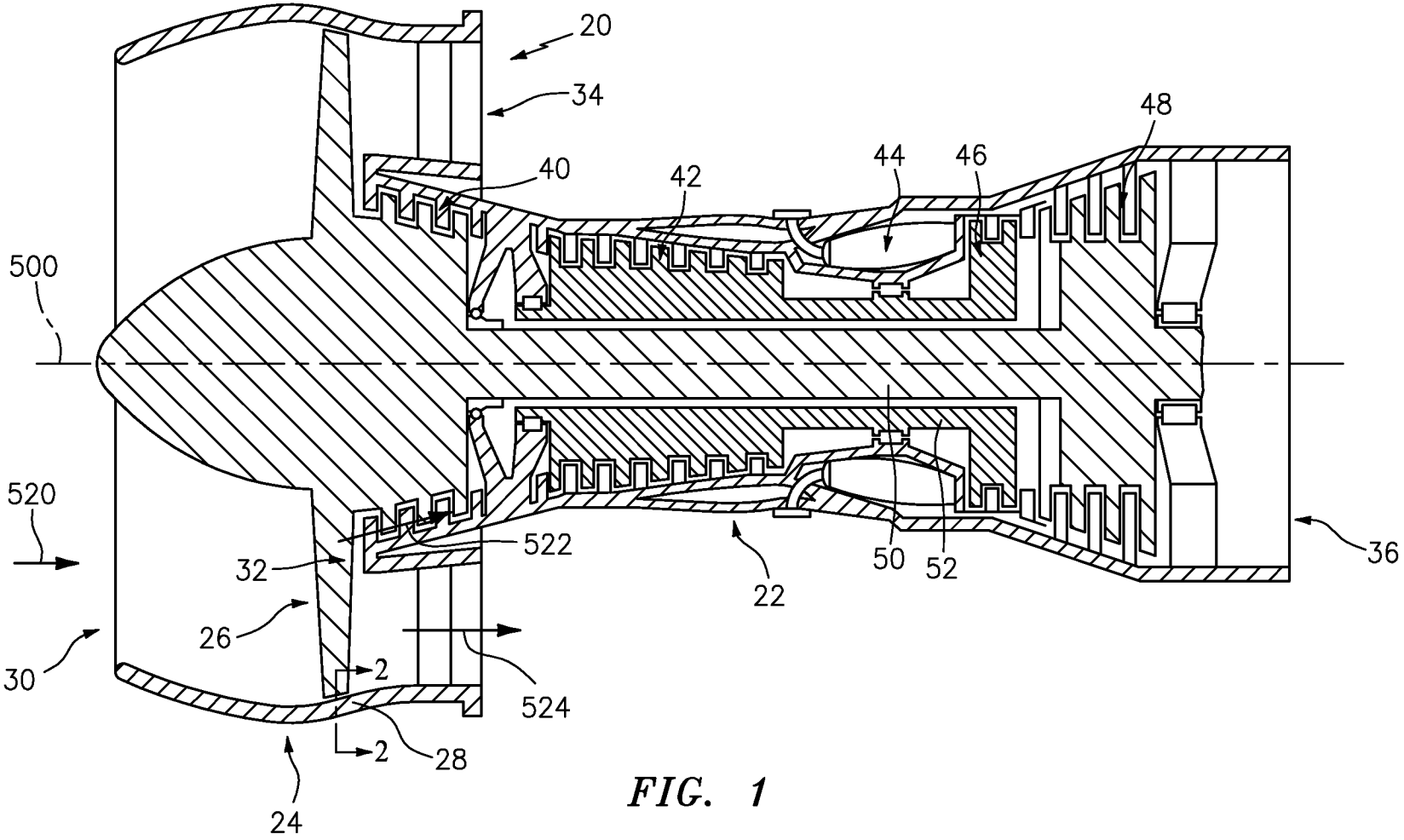
FIG. 1 is a partially schematic half-sectional view of a turbofan engine.

FIG. 1 shows a gas turbine engine 20 having an engine case 22 surrounding a centerline or central longitudinal axis 500. An exemplary gas turbine engine is a turbofan engine having a fan section 24 including a fan 26 within a fan case 28. The exemplary engine includes an inlet 30 at an upstream end of the fan case receiving an inlet flow along an inlet flowpath 520. The fan 26 has one or more stages 32 of fan blades. Downstream of the fan blades, the flowpath 520 splits into an inboard portion 522 being a core flowpath and passing through a core of the engine and an outboard portion 524 being a bypass flowpath exiting an outlet 34 of the fan case.

The core flowpath 522 proceeds downstream to an engine outlet 36 through one or more compressor sections, a combustor, and one or more turbine sections. The exemplary engine has two axial compressor sections and two axial turbine sections, although other configurations are equally applicable. From upstream to downstream there is a low pressure compressor section (LPC) 40, a high pressure compressor section (HPC) 42, a combustor section 44, a high pressure turbine section (HPT) 46, and a low pressure turbine section (LPT) 48. Each of the LPC, HPC, HPT, and LPT comprises one or more stages of blades which may be interspersed with one or more stages of stator vanes.

In the exemplary engine, the blade stages of the LPC and LPT are part of a low pressure spool mounted for rotation about the axis 500. The exemplary low pressure spool includes a shaft (low pressure shaft) 50 which couples the blade stages of the LPT to those of the LPC and allows the LPT to drive rotation of the LPC. In the exemplary engine, the shaft 50 also drives the fan. In the exemplary implementation, the fan is driven via a transmission (not shown, e.g., a fan gear drive system such as an epicyclic transmission) to allow the fan to rotate at a lower speed than the low pressure shaft.

The exemplary engine further includes a high pressure shaft 52 mounted for rotation about the axis 500 and coupling the blade stages of the HPT to those of the HPC to allow the HPT to drive rotation of the HPC. In the combustor 44, fuel is introduced to compressed air from the HPC and combusted to produce a high pressure gas which, in turn, is expanded in the turbine sections to extract energy and drive rotation of the respective turbine sections and their associated compressor sections (to provide the compressed air to the combustor) and fan.

Figure 2:
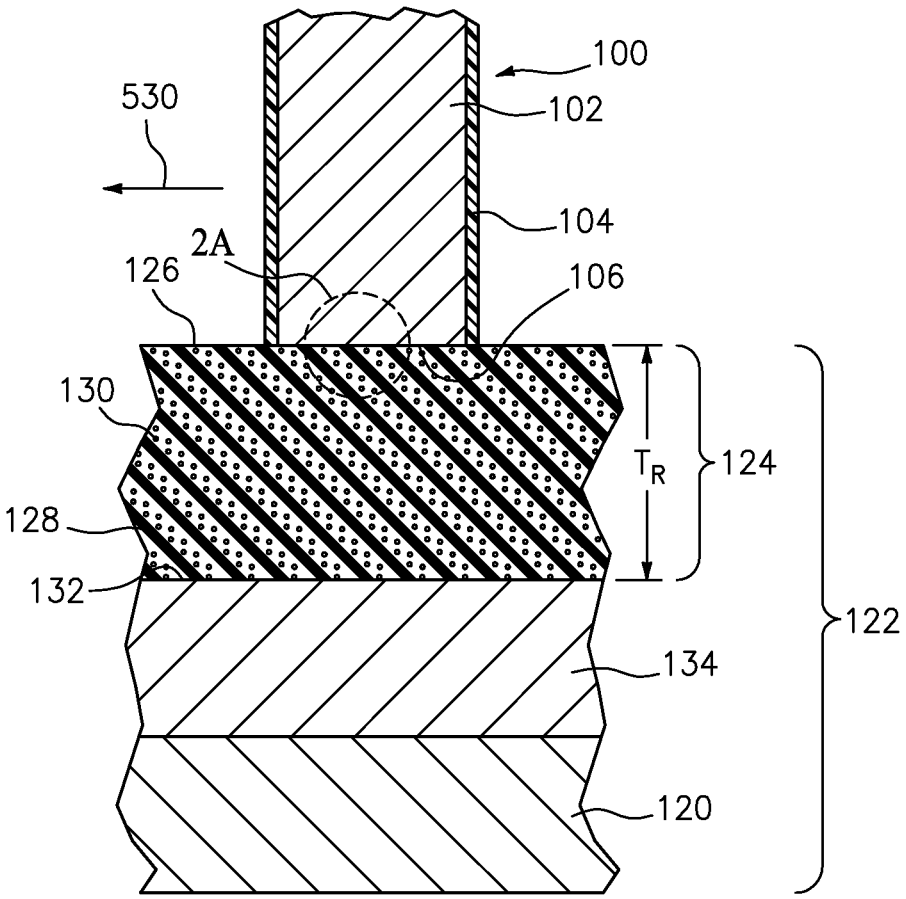
FIG. 2 is an enlarged transverse cutaway view of a fan blade tip region of the engine of FIG. 1 taken along line 2-2 and showing a first rub coating.

FIG. 2 shows a cutaway blade 100 showing a blade substrate (e.g., an aluminum alloy) 102 and a polymeric coating 104 (e.g., a polyurethane-based coating) on the substrate. The exemplary coating is along pressure and suction sides and spans the entire lateral surface of the blade between the leading edge and trailing edge. The exemplary coating, however, is not on the blade tip 106. If originally applied to the tip, the coating may have been essentially worn off during rub. Circumferential movement in a direction 530 is schematically shown.

FIG. 2 also shows an overall structure of the fan case facing the blade. This may include, in at least one example, a structural case 120. It may also include a multi-layer liner assembly 122. An inboard layer of the liner assembly may be formed by a rub material 124. The exemplary rub material 124 has an inboard/inner diameter (ID) surface 126 facing the blade tips and positioned to potentially rub with such tips during transient or other conditions.

The exemplary rub material 124 comprises a polymeric matrix material 128 and a filler 130 (e.g., polymeric particles or micro-balloons or glass micro-balloons). The exemplary rub material may be formed as a coating on an ID surface 132 of a substrate 134 of the liner assembly. An exemplary substrate 134 is titanium alloy AMS 4911. The rub material is shown as having an overall thickness $T_R$. Exemplary $T_R$ is 1-10 mm, more particularly, 3-6 mm. Alternative abradable rub material may include metal matrix composites (e.g., formed by thermal spray coating).

Figure 2A:
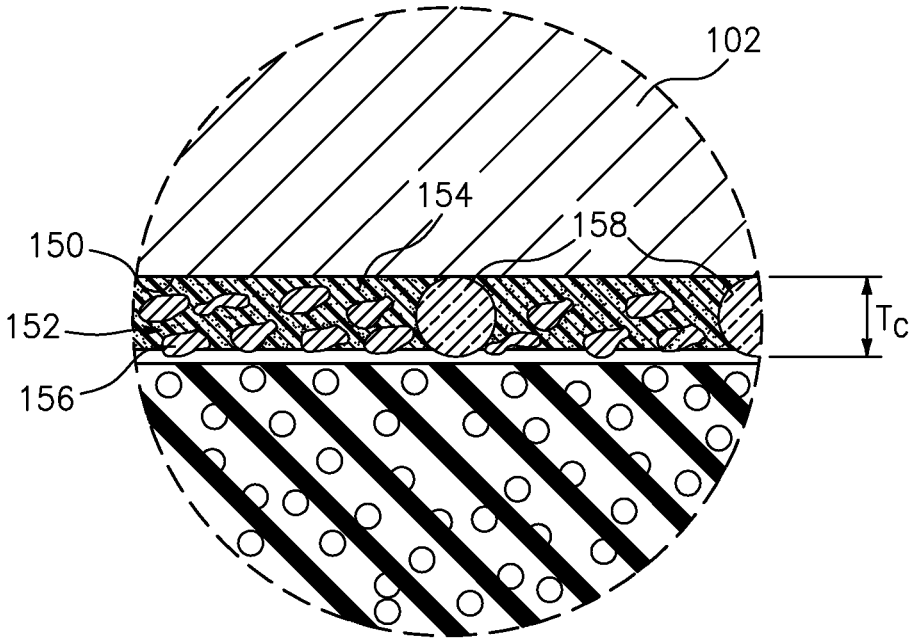
FIG. 2A is an enlarged view of a blade tip region of FIG. 2.

FIG. 2A shows the tip region 106 with a tip surface 150 of the substrate bearing a coating 152. The coating 152 comprises matrix 154 and abrasive 156. The coating has a thickness $T_C$. Exemplary $T_C$ is 2-35 mils (50 micrometers to 0.9 mm), more particularly, 4-12 mils (0.1 mm to 0.3 mm). As is discussed further below, the coating further includes an additional particulate 158 whose function is to define the initial coating thickness $T_C$. Thus the particulate 158 has transverse dimensions (e.g., diameter) greater than characteristic transverse dimensions of the individual particles of the abrasive 156.

The matrix is a hardenable/curable non-metallic matrix material. In one example, the matrix (or precursor) is initially in a fluid state (e.g., a viscous liquid) and is mixed with the abrasive 156 and the additional particulate 158. The mixture is then applied to the surface 150 to a thickness (at least average) greater than $T_C$. To provide uniform initial $T_C$, the mixture may be compressed. Exemplary compression involves compressing against a release member and/or a sacrificial member. The exemplary release member may bear a release coating to facilitate its release from the matrix. The release member is then compressed against the substrate until the release member and substrate bottom out relative to each other held separated by the additional particulate 158 (e.g., if circular particles, the release member and substrate will be separated by the particle diameter (subject to slight deformation etc.)). The matrix precursor may be allowed to fully or partially harden or cure. The release member may then be removed (e.g., peeled off), leaving an essentially uniformly thick coating of the desired initial thickness $T_C$. The release member may potentially be reusable (e.g., if a metallic strip) or may be disposable. Alternative sacrificial members may not be releasably removable but may be removed by other means such as chemical means or abrading.

Figure 3:
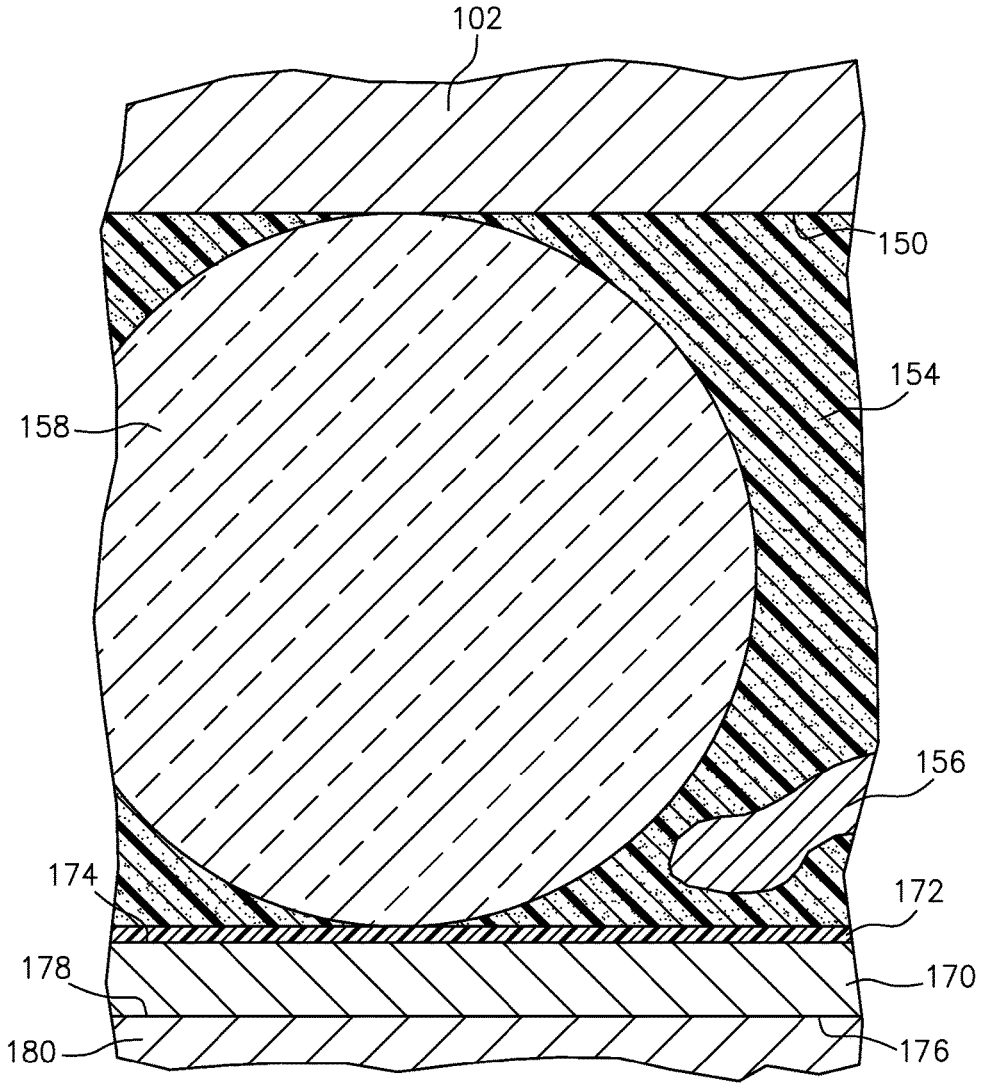
FIG. 3 is an enlarged transverse cutaway view of the blade tip region during coating application.

FIG. 3 shows the mixture 160 applied to the substrate and then contacted with a release member 170 bearing a release coating or agent 172 on an upper surface 174. A lower surface 176 is engaged to the upper surface 178 of a base 180 of a fixture. The surface 178 is shaped to correspond to the curvature of the surface 150. For example, it is shaped to correspond to the inner diameter (ID) surface of a fan case to which the blades are expected to interface in operation. The blade is biased in a direction 540 to compress the mixture between the substrate and release member until the additional particulate 158 acts as a stop.

Exemplary matrix material is an epoxy.

Exemplary abrasive is a grit. Exemplary grit Mohs hardness is at least 7.5, more narrowly, at least 8.0. Exemplary grit composition comprises a by weight majority of one or more oxides, carbides, nitrides, carbo-nitrides, or diamond (e.g., alumina and/or zirconia or alumina-based and/or zirconia-based (e.g., at least 50% alumina and/or zirconia by weight or alumina or zirconia as a largest by-weight component with titania being a candidate addition), silicon carbide, silicon nitride, boron carbide, boron nitride, titanium carbide, titanium nitride, and the like. A characteristic particle size and morphology is 1 mil to 3 mil (25 micrometers to 76 micrometers), more broadly 10 micrometers to 150 micrometers 98 wt % pure alumina particles produced by fusing and crushing to form angular particles. Exemplary volume fraction for the grit is 22% of overall volume, more broadly, 10% to 50% by volume or 20% to 45% by volume.

Exemplary spacers are beads. Exemplary beads are glass beads. Exemplary bead size is characteristic diameter of 0.012 inch (0.3 mm), more broadly 0.20 mm to 0.80 mm or 0.20 mm to 0.50 mm. Exemplary bead content for 0.012 inch (0.3 mm) diameter beads is 5% by volume, more broadly 1% to 20% by volume or 3% to 10% by volume. The volume fraction of beads required is reduced with smaller bead diameter (because at smaller bead size more contact points per area result from a given volume fraction). For non-spherical (e.g., generally ellipsoidal) dimension corresponding to the diameter would be the minor axis dimension.

An exemplary release member is sheet metal strip or metallic foil (e.g., stainless steel). Exemplary release agent is polydimethylsiloxane polymer or a polytetrafluoroethylene.

An exemplary manufacture process involves forming the blade substrate by conventional means (e.g., forging and/or machining and peening). Portions of the blade may be masked. For example, some blade configurations have a titanium leading edge separated from an aluminum substrate by a slight gap (e.g., epoxy-filled for galvanic isolation). The tip surface of the titanium leading edge member and the gap may be covered with the abrasive coating if it is not electrically conductive. Yet alternative blades may lack metallic substrates and the tip coating may be applied to a non-metallic portion such as a fiber composite.

Figure 4:
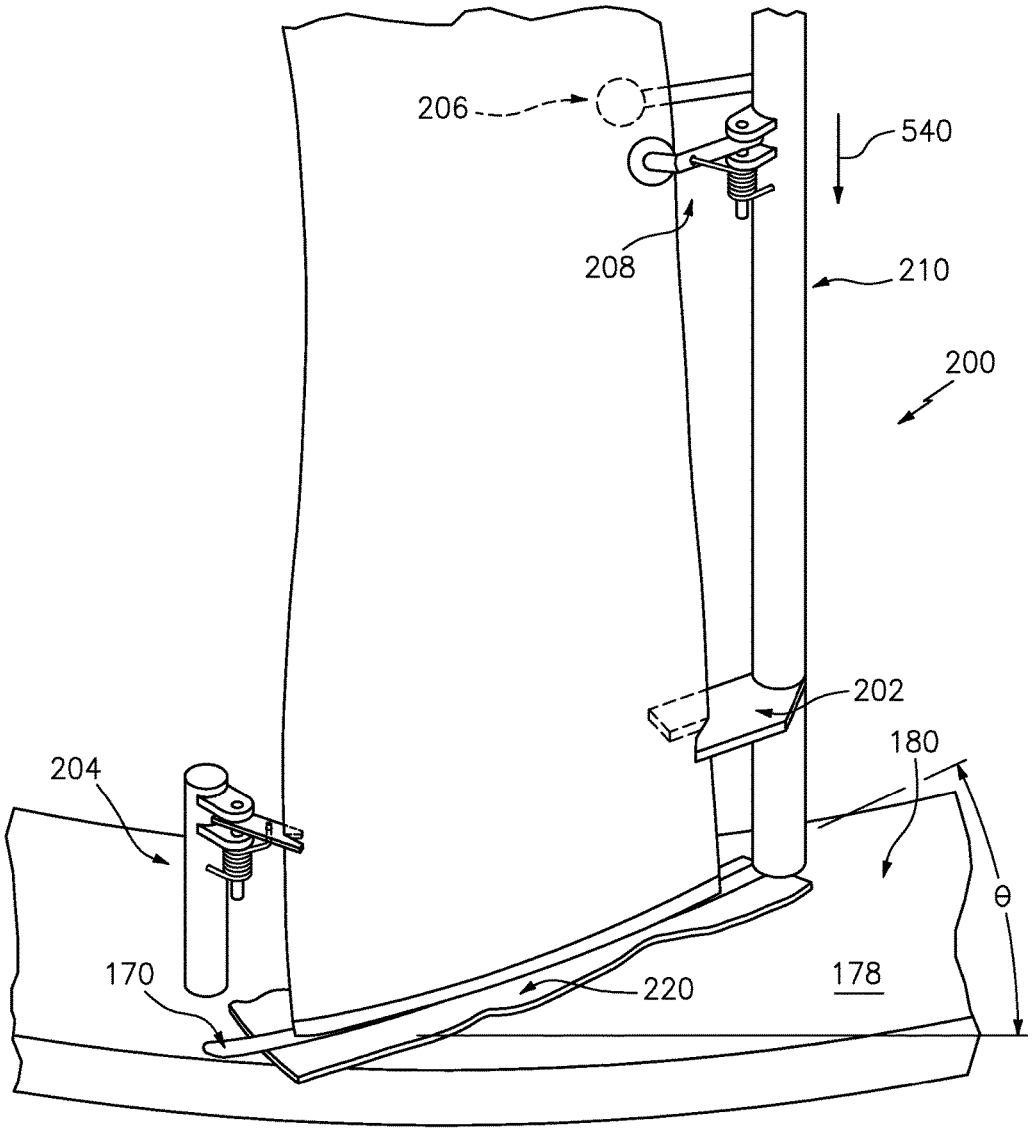
FIG. 4 is a view of a fixture for applying coating to the blade tip region, with blade root cut away.

FIG. 4 shows an exemplary fixture 200 for applying the tip coating. The fixture 200 includes the base 180. The exemplary fixture also includes means for holding the blade in a desired operational orientation relative to the base. The exemplary means engages the blade at leading and trailing edges and pressure and suction sides. This includes an exemplary leading edge stop 202 having a concave recess complementary to a leading edge region of the airfoil near the tip. This stop 202 may be a rigid stop. To hold the blade up against the leading edge stop 202, a trailing edge engagement feature 204 may comprise a spring-loaded arm or other means. The trailing edge engagement feature 204 thus acts as a spring-loaded stop and may similarly have a channel for receiving and engaging a portion of the airfoil along the trailing edge.

For holding the blade at the proper tilt orientation (e.g., tilt about axes generally near parallel to the chord), the fixture has a pressure side engagement feature 206 and a suction side engagement feature 208 respectively contacting the blade along the pressure side and the suction side closer to the root. As with the relationship of the leading edge stop to the trailing edge engagement feature, one of these may be rigid or fixed while the other is spring-loaded or otherwise movable. In this example, the pressure side engagement feature 206 is rigidly held while the suction side engagement feature 208 is spring-loaded and biased toward the pressure side engagement feature to clamp the blade between these engagement features. Exemplary engagement features comprise end members for actually contacting the blades. Exemplary end members are low-friction non-metallic pads (e.g., polyamide) or low-friction ball rollers.

The exemplary leading edge stop 202 and engagement features 206 and 208 are both mounted on a single post 210 extending upward from the base 180.

FIG. 4 also shows an optional compliant pad 220 between the upper surface 178 of the base 180 and the lower surface or underside 176 of the release member. This pad helps accommodate small tolerance variations.

Relative to uncoated tips or alternative coatings the exemplary coating may have one or more of several advantages. For example, it may effectively cut the outer air seal abradable while maintaining low blade tip temperature resulting in survival of polymeric erosion-resistant coatings. It may provide an engineered wear ratio with the abradable (i.e., itself wear in length to produce a more round blade tip assembly and result in smaller average clearance and higher efficiency).

An alternative embodiment involves pre-forming the tip coating (or a precursor layer thereof) with a desired thickness and then applying it to the blade tip. In one example, two release members are coated with release agent and the precursor mixture applied between the release members. The release members are then subject to a roller operation or other relative compressing to press the mixture between the release members. The additional particulate in the mixture again acts as a stop to limit thickness reduction of the mixture to the desired initial thickness. The mixture may then be fully or partially cured. One of the release members may then be disengaged from the at least partially cured mixture. To this end, it may be desirable that the two release members or associated release agents may be different in composition or thickness so as to allow one release member to be removed preferentially to the other. The remaining release member bearing the mixture is then applied to the blade tip and that release member may be removed. This may occur after a further curing to adhere the mixture to the tip. In various embodiments, the tip may be pre-coated with a primer or additional adhesive such as epoxy so as to facilitate bonding therebetween.

Further variations involve multiple distinct layers of the tip coating. In one example, a non-abrasive layer is applied atop the abrasive coating. For example, this non-abrasive layer may be the same polymeric coating (e.g., polyurethane) applied to pressure and suction sides of the airfoil in the same application step. A purpose of such an additional layer may be to accommodate variations such as manufacturing tolerances in the radii of the blade tips relative to the engine axis.

An alternative non-abrasive layer may be formed by an additional layer of the matrix material. This layer may be applied separately or may result from settling or other non-uniform distribution of abrasive within the matrix (see discussion below).

In one example of manufacturing variances, a first blade substrate protrudes slightly more radially than a second blade substrate, if the first blade substrate is dimensioned so that its tip coating just abrades the liner, then there will be a gap between the tip coating of the second blade and the liner resulting in blowby and loss of efficiency. The non-abrasive layer fills this gap. If, instead, the shorter airfoil is dimensioned to just abrade the coating then there will be greater interference between the abrasive coating on the longer airfoil and the liner causing rapid wear of the liner and then similarly resulting in blowby. Accordingly, it may be desirable to select typical manufacturing tolerances so that only the longer blades within the variation will have interference of their abrasive coating layer with the liner. The non-abrasive layer on those longer blades will be quickly worn away without undue loss of liner material. Thereafter, the longer blades may account for a larger fraction of the liner wear while allowing the shorter blades to avoid blowby due to their intact non-abrasive outer layer.

Another option for a multi-layer coating is to use a similar application process to that used for the layer 152. In this process, the additional particulate may be similar to that used in applying the first layer (although its size may be chosen to correspond to a desired size for the second layer). Abrasive may be totally eliminated or reduced relative to the abrasive content of the first layer. For example, an inboard abrasive layer may be chosen to have an abrasive concentration (e.g., of 30% by volume) and a thickness (e.g., of 10 mils (0.25 mm)) and an outboard abrasive layer may be chosen with a lower abrasive concentration (e.g., of 6% by volume). The outboard layer may have a different thickness such as a greater thickness (e.g., of 20 mils (0.5 mm)). The layers have wear ratios with the outer air seal that are proportional to their abrasive concentrations. During rub interaction, the wear rate of the abrasive tip will go down (e.g., by a factor of about five in this example) when the inboard layer becomes exposed.

As is noted above, a varying content of abrasive may for example be achieved by settling or by other means such as applying separate layers. One example of a multi-layer system involves a progressive decrease in abrasive content from the inboard or base layer through the outboard layer. One example of such a system involves a hypothetical substitution for a single-layer system having 20% by volume abrasive in a layer 0.5 mm thick. This layer may be replaced with a two-layer system wherein all the abrasive is concentrated in the inboard layer (e.g., within the inboard half of the thickness). A lower/inboard layer may be applied 0.25 mm thick with 40% by volume abrasive and then the upper/outer layer of abrasive-free epoxy deposited 0.25 mm thick. Abrasive settling in a situation where the initial layer is applied 0.5 mm thick could achieve a similar result (or one with slightly more or slightly less bias of the abrasive toward the substrate).

The variation in abrasive content from the substrate outward may be selected to achieve one or more of several purposes. For example, one implementation of a relatively highly abrasive outermost layer is to provide a coating that quickly rounds the adjacent fan case liner but is worn off in the process. Once the fan case liner is rounded, a lower abrasive content in what was previously an intermediate portion of the tip coating may have an advantageous set of properties. For example, it may still maintain the fan case temperature sufficiently low and still maintain sufficient sealing while not unduly quickly shortening the life of the case liner.

In some examples, due to blade length variation, the coating may have very low or essentially no abrasive content in an inboard portion. The abrasive material will wear off with the outer portions of the tip coating of the longer blades leaving the abrasive on the tip coating of the shorter blades to handle the duties of interfacing with the case liner.

However, an alternative example wherein the abrasive content is higher near the substrate may achieve equalization of effective blade length by being quickly abraded off the longer blades. This leaves the exposed higher abrasive content layer of the longer blades to abrade the liner while the abrasive of the shorter blades perhaps never engages the liner as the non-abrasive layer above never wears down.

In such exemplary situations where the outer portion of the tip coating is non-abrasive, its thickness does not need to be subject to precise control because it can quickly wear down without correspondingly abrading the liner. Accordingly, other techniques may be used for applying an outboard non-abrasive layer that do not have precise thickness control (e.g., spraying).

Figure 5:
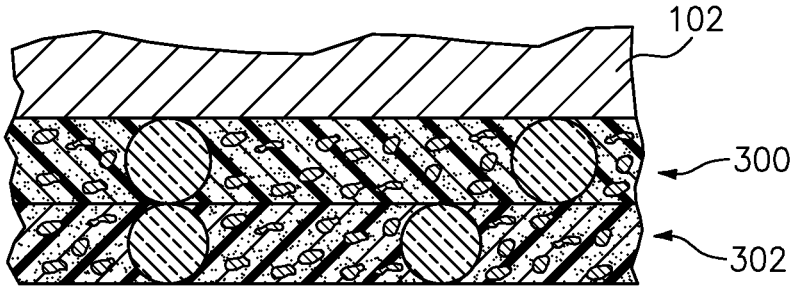
FIG. 5 is an enlarged view of a blade tip region with a first alternate coating.

FIG. 5 shows an example of a two-layer tip coating wherein an inboard layer 300 and an outboard layer 302 both include abrasive (although of different composition or volume fraction) and the aforementioned additional particulate which determines layer thickness.

Figure 6:
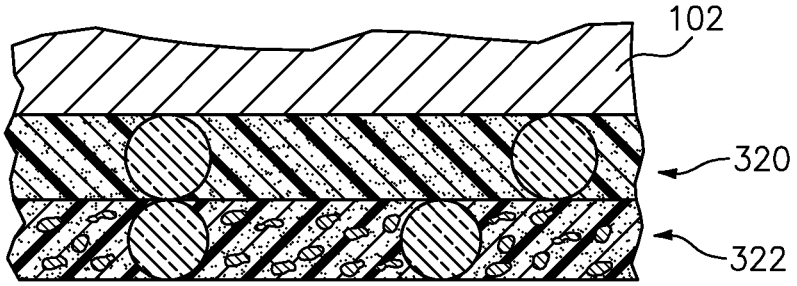
FIG. 6 is an enlarged view of a blade tip region with a second alternate coating.

FIG. 6 shows a variation wherein the inboard layer 320 lacks such abrasive but the outboard layer 322 has such abrasive.

Figure 7:
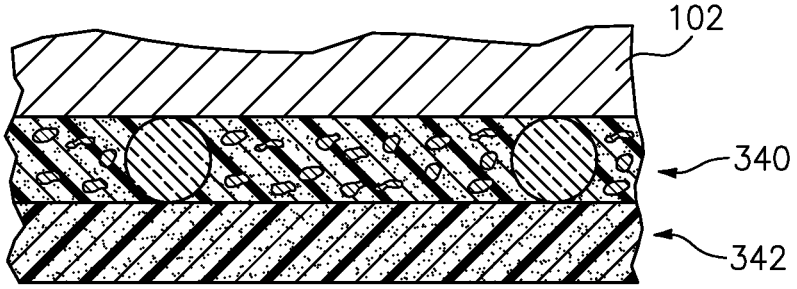
FIG. 7 is an enlarged view of a blade tip region with a third alternate coating.

FIG. 7 shows a variation wherein the inboard layer 340 has both the abrasive and the additional particulate. The outboard layer 342 lacks at least the abrasive and, as shown, the additional particulate.

The use of "first", "second", and the like in the following claims is for differentiation within the claim only and does not necessarily indicate relative or absolute importance or temporal order. Similarly, the identification in a claim of one element as "first" (or the like) does not preclude such "first" element from identifying an element that is referred to as "second" (or the like) in another claim or in the description.

Where a measure is given in English units followed by a parenthetical containing SI or other units, the parenthetical's units are a conversion and should not imply a degree of precision not found in the English units.

One or more embodiments have been described. Nevertheless, it will be understood that various modifications may be made. For example, when applied to an existing baseline configuration, details of such baseline may influence details of particular implementations. Accordingly, other embodiments are within the scope of the following claims.

What is claimed is:

1. A method for manufacturing an airfoil tip coating, the airfoil tip coating comprising an abrasive and a matrix, the method comprising:

forming a mixture comprising the abrasive, a precursor of the matrix, and an additional particulate; and pressing the mixture, the additional particulate having a larger characteristic size than the abrasive and acting as a stop to limit thickness reduction of the mixture.

2. The method of claim 1 further comprising:

curing the precursor of the matrix.

3. The method of claim 1 further comprising:

releasing a release member from the mixture.

4. The method of claim 1 wherein the airfoil comprises:

a root end and a tip; and a substrate along at least a portion of the airfoil, and the method comprises:

applying the mixture to the tip.

5. The method of claim 4 wherein:

the pressing comprises pressing a member against the applied mixture, the additional particulate acting as a stop to limit proximity of the member to the substrate.

6. The method of claim 5 further comprising:

curing the precursor of the matrix; and releasing the tip coating from the member.

7. The method of claim 1 wherein:

the tip coating is a first layer; and the method further comprises forming a second layer having a lower abrasive content than the first layer.

8. The method of claim 7 wherein:

the second layer is formed atop the first layer by:

forming a second mixture comprising a second abrasive, a second matrix precursor, and a second additional particulate; and pressing the second mixture, the second additional particulate acting as a stop to limit thickness reduction of the second mixture.

9. The method of claim 1 wherein:

the tip coating has a content of the abrasive of at least twenty volume percent; and the tip coating has a content of the additional particulate of three volume percent to ten volume percent.

10. The method of claim 1 wherein:

the additional particulate has characteristic diameter of 0.20 mm to 0.80 mm; and the abrasive has a characteristic size of ten micrometers to 150 micrometers.

11. The method of claim 1 wherein:

the additional particulate is glass bead.

12. The method of claim 1 wherein:

the abrasive is at least 50 percent by weight oxide of one or more of aluminum, titanium, and zirconium.

13. The method of claim 1 wherein:

the tip coating has a characteristic thickness of 0.1 mm to 0.3 mm.

14. The method of claim 4 wherein:

prior to the applying, a release agent is between the first release member and the mixture and the second release member and the mixture; and the release agent comprises polydimethylsiloxane polymer.

15. The method of claim 1 further comprising:

after applying the tip coating, applying a polymeric coating to a pressure side and a suction side of the airfoil.

16. The method of claim 15 wherein:

the polymeric coating is also applied atop the tip coating.

17. A method for manufacturing a coating, the coating comprising an abrasive and a matrix, the method comprising:

forming a mixture comprising the abrasive, a precursor of the matrix, and an additional particulate; and pressing the mixture, the additional particulate being beads and acting as a stop to limit thickness reduction of the mixture.

18. The method of claim 17 wherein:

the beads are glass beads.

19. The method of claim 17 wherein:

the matrix comprises an epoxy; and the abrasive is at least 50 percent by weight oxide of one or more of aluminum, titanium, and zirconium.

* * * * *